US011879309B2

(12) United States Patent
Hope et al.

(10) Patent No.: US 11,879,309 B2
(45) Date of Patent: Jan. 23, 2024

(54) METHOD AND DEVICE FOR SUPPLYING LIQUID TO A LINER

(71) Applicant: Smarthose AS, Stavanger (NO)

(72) Inventors: Helge Hope, Årland (NO); Alf Breivik, Ulvik (NO)

(73) Assignee: Smarthose AS, Stavanger (NO)

( * ) Notice: Subject to any disclaimer, the term of this patent is extended or adjusted under 35 U.S.C. 154(b) by 0 days.

(21) Appl. No.: 17/268,262

(22) PCT Filed: Aug. 15, 2018

(86) PCT No.: PCT/NO2018/050210
§ 371 (c)(1),
(2) Date: Feb. 12, 2021

(87) PCT Pub. No.: WO2020/036491
PCT Pub. Date: Feb. 20, 2020

(65) Prior Publication Data

US 2021/0301628 A1 Sep. 30, 2021

(51) Int. Cl.
*E21B 21/10* (2006.01)
*E21B 41/00* (2006.01)
(Continued)

(52) U.S. Cl.
CPC ..... *E21B 41/00* (2013.01); *E21B 19/06* (2013.01); *E21B 19/16* (2013.01); *E21B 21/01* (2013.01)

(58) Field of Classification Search
CPC ..... E21B 19/106; E21B 19/16; E21B 41/00
See application file for complete search history.

(56) References Cited

U.S. PATENT DOCUMENTS 3,833,076 A * 9/1974 Griffin, III ..... E21B 21/08 175/38
3,991,837 A 11/1976 Crickmer
(Continued)

FOREIGN PATENT DOCUMENTS

CN 2228973 Y 6/1996
CN 200968198 Y 10/2007
(Continued)

OTHER PUBLICATIONS

International Search Report for International Patent Application No. PCT/NO2018/050210, dated Mar. 12, 2019 in 3 pages.
(Continued)

*Primary Examiner* — Taras P Bemko
*Assistant Examiner* — Ronald R Runyan
(74) *Attorney, Agent, or Firm* — Knobbe, Martens, Olson & Bear, LLP

(57) ABSTRACT

A method is described for supply of liquid from a liquid storage to a casing string (10,12, 14..) which from a deck (16) on an installation is conveyed down in a well with the help of a pipe handler comprising an elevator, where the liquid is supplied via an uppermost casing (10) which is added to the casing string, and the liquid is supplied through a filling pipe (30) via an outlet nozzle (36) to the top of the casing (10) already during the pipe's (10) screwing into the casing string (10, 12, 14..) where the filling pipe is extended during the liquid supply until the casing string is being lowered down to a position where it is securely locked to the deck (16), and liquid is added to a suitable level in the casing string. The method is characterised in that the filling pipe (30) is extended in that it comprises a telescopic axially moveable pipe end part (35) with a constricted outlet (36) which leads to the pipe end part (35) being pushed axially outwards and extends the filling pipe (30) when the liquid is
(Continued)

supplied under pressure, and the pipe end part (35) is pushed outwards under the counter effect of a prestressing force, and pulled back under the influence of said prestressing force when the liquid supply stops. Also described is a device as given in claim 10.

11 Claims, 3 Drawing Sheets

(51) Int. Cl.

| | |
|---|---|
| ***E21B 19/06*** | (2006.01) |
| ***E21B 19/16*** | (2006.01) |
| ***E21B 21/01*** | (2006.01) |

(56) References Cited

U.S. PATENT DOCUMENTS

| | | | | |
|---|---|---|---|---|
| 5,191,939 | A * | 3/1993 | Stokley | E21B 19/00 166/387 |
| 5,682,952 | A * | 11/1997 | Stokley | E21B 21/019 166/387 |
| 5,735,348 | A * | 4/1998 | Hawkins, III | E21B 21/01 166/285 |
| 5,918,673 | A | 7/1999 | Hawkins et al. | |
| 6,173,777 | B1 * | 1/2001 | Mullins | E21B 33/126 166/387 |
| 6,182,755 | B1 * | 2/2001 | Mansure | F16J 15/028 277/340 |
| 6,460,620 | B1 | 10/2002 | LaFleur | |
| 2006/0011354 | A1 * | 1/2006 | Logiudice | E21B 21/103 166/380 |
| 2006/0027360 | A1 | 2/2006 | Basso | |
| 2006/0118293 | A1 * | 6/2006 | Juhasz | E21B 19/07 166/77.51 |
| 2006/0151181 | A1 | 7/2006 | Shahin | |
| 2009/0266532 | A1 * | 10/2009 | Revheim | E21B 21/106 166/53 |
| 2010/0012324 | A1 | 1/2010 | Churchill | |
| 2010/0051290 | A1 | 3/2010 | Williford | |
| 2010/0206584 | A1 | 8/2010 | Clubb et al. | |
| 2011/0005777 | A1 * | 1/2011 | Meff | E21B 19/143 166/382 |
| 2012/0048574 | A1 | 3/2012 | Wiens et al. | |
| 2015/0300107 | A1 | 10/2015 | Mullins et al. | |

FOREIGN PATENT DOCUMENTS

| | | | | |
|---|---|---|---|---|
| CN | 202325397 | U | 7/2012 | |
| CN | 102656336 | A | 9/2012 | |
| CN | 102839941 | * | 12/2012 | E21B 33/13 |
| CN | 102839941 | A | 12/2012 | |
| NO | 20170235 | A1 | 8/2018 | |
| WO | 98/50672 | A1 | 11/1998 | |
| WO | 2007/108703 | A1 | 9/2007 | |

OTHER PUBLICATIONS

Search Report issued in the corresponding Chinese Patent Application No. 2018800966348, dated Aug. 24, 2022 in 2 pages.
Indian Office Action issued for corresponding Indian Patent Application No. 202147008062, dated Nov. 10, 2022 in 5 pages.
Search Report issued in the corresponding Chinese Patent Application No. 2018800966348, dated Mar. 1, 2023 in 6 pages including English translation.

* cited by examiner

METHOD AND DEVICE FOR SUPPLYING LIQUID TO A LINER

CROSS-REFERENCE TO RELATED APPLICATIONS

This application is the U.S. National Phase under 35. U.S.C. § 371 of International Application PCT/NO2018/050210, filed Aug. 15, 2018.

FIELD OF THE INVENTION

The present invention relates to a method for supply of liquid from a liquid storage to a casing string which from a deck on an installation is submersed into a well with the help of a pipe handler comprising an elevator, where the liquid is supplied via an uppermost casing that is added to the casing string, and the liquid is supplied through a filling pipe via an outlet nozzle to the top of the casing already during the screwing into the casing string where the filling pipe is extended during the liquid supply up to when the casing string is being submersed to a position where it is securely locked to the deck, and liquid is supplied to an adequate level in the casing string, as given in the subsequent claim 1.

The invention also relates to a device for a filling pipe for delivery of liquid through an outlet nozzle to a casing string in a well in connection with an installation, where the pipe end part of the filling pipe is telescopically extendable and can be pushed outwards during the delivery of the liquid and thereafter pulled back, as given in the subsequent claim 10.

In particular, the invention relates to a device for supply of drilling liquid from a storage on an oil installation to a casing which is about to be installed section by section to a casing string in a drilled well in a fluid-carrying formation in the sub-terrain.

BACKGROUND OF THE INVENTION

There are strict regulations that drilling operations shall be safe and efficient. Operations that are carried out at and around a drilling deck are always subjected to continuous improvements. In all areas, including the Norwegian continental shelf, all activities are logged in detail and analysed down to seconds. From this analysis, statistical reports are generated that are used in the dialogue between land-based organisations and offshore organisations to improve the quality of the operations at all levels.

It has been found that some operations are inappropriately more time consuming than necessary. This applies for instance to the process of filling of casing pipes during commissioning. Today, it is known to supply drilling liquid to casings directly through the drill's "saver sub". This takes place when the top of the casing, or the length of joined sections of casings, stands unattached to the drilling deck, i.e. temporarily locked with the help of slips. As a consequence of the casing being unattached, the Top Drive with the "elevator" is free and one can lower the Top Drive with the saver sub as close to the top of the casing as one wishes.

One avoids spillages as the "saver sub" can be brought much nearer to the top of the casing. Such filling of casings takes place at given intervals, for example for every time 5-20 pipe lengths are inserted, so that the hydrostatic pressure difference internally and externally down in the well shall not be too large. Casings are led into the well with a tight pipe in the bottom, and therefore no liquid will flow in from the bottom of the casing. The top of the casing is filled with air during commissioning, while one has a liquid at the outside. This leads to a pressure difference between the inside and the outside, something that is evened when a casing is filled up with a fluid.

DESCRIPTION OF PRIOR ART

With regard to prior art, reference is made to a solution outlined, where a so-called Casing Running Tool is outlined by National Oilwell Varco, and also a "Single valve" appliance for the filling of casings and for circulation equipment, described in the U.S. Pat. No. 6,173,777.

These known methods also consider other problems than those related to the present invention. According to the first mentioned solution one can both rotate the casing and circulate liquid through it, while U.S. Pat. No. 6,173,777 primarily relates to circulation of liquid through the casing. For both known methods are then the casings filled with a liquid.

Reference is also made to the following patents: International application WO 98/50672, U.S. Pat. Nos. 5,682,952, 5,191,939, US 2012/0048574, US 2010/0012324, US 2010/0206584 and also US 2015/0300107.

Of these, WO 98/50672 and U.S. Pat. No. 5,682,952 are the closest to the present invention. The former mentions that driving the extendable pipe forwards and back takes place by a screw function.

U.S. Pat. No. 5,682,952 describes that there is a separate liquid under pressure that shall push the pipe forwards, as a telescopic spring-prestressed filling pipe is described where the telescopic housing is connected to a liquid storage via a pipeline. Pressure liquid supplied to the telescopic housing contributes to the telescope part being pushed out and extended. Therefore, this pressure system is separate from the system that supplies liquid through the pipe itself.

Thus, the solution in these variants in these two patents are completely different from what the present invention aims at, as the telescope operation in these is not influenced by pressure liquid which shall be supplied to the casing. The use of such supply liquid for the pushing operation according to the invention is consequently not described.

Disadvantages with the Prior Art

The disadvantage with the solution according to U.S. Pat. No. 5,682,952 is that a drilling rig must now incorporate yet another system with a storage, and a pressure transmitter to provide hydraulics to the extendable piston, in an area on a drilling rig where there is already a shortage of space. Furthermore, they are costly both to purchase and to use, and also one has to add a time consuming up and down rigging of the equipment. This is a major factor in the progress of the operation.

Objects of the Present Invention

It is an object of the invention to provide a new apparatus that improves the filling of a balancing liquid in a receiver pipe in the form of a casing on an operating deck on an installation.

It is a further object of the invention to provide a filling apparatus that is much more flexible when it comes to being able to be adapted to the different distances that may occur between the outlet that leads the liquid from the storage, and up to the top/entry of the uppermost section of the casing.

Furthermore, it is an object to provide a filling apparatus, which is better protected against sideways-directed impacts.

One object is also to provide a filling apparatus that can be aligned towards the inlet of the casing section at an earlier point in the operation than what has been possible before.

One also aims for a solution where the outlet pipe is comprised of an articulated construction, which means that it can be swung sideways during the fitting of the casing.

Furthermore, it is an object to provide several alternative embodiments of a filling apparatus with its telescopic constructions.

Furthermore, it is an object of the invention to be able to simplify the fittings on an installation and reduce the number and extent of equipment, etc., to provide a forwards and back movement of the pipe during the supply of liquid to the casing.

SUMMARY OF THE INVENTION

The method according to the invention is characterised in that the filling pipe is extended in that comprises a telescopic axially movable pipe end part with a constricted outlet which means that the pipe end part is pushed axially outwards and extends the filling pipe when the liquid is supplied under pressure, and the pipe end part is pushed outwards during the counter effect from a prestressed force and is pulled back by the influence of said prestressed force when the supply of liquid ceases.

According to a preferred embodiment the prestressed force is provided in that the pipe end part is connected to a filling pipe by a spring which is clamped together when the pipe end part is extended when the liquid is supplied under pressure, and the spring contributes by pulling the pipe end part back to its initial position when the liquid pressure is reduced.

According to a preferred embodiment the prestressed force is provided in that the filling tube and the end tube part define between themselves a closed gas-filled volume that is compressed when the pipe end part is pushed forwards as a consequence of the increased liquid pressure, and the pipe end part is pulled back as a consequence of the gas expansion when the liquid pressure decreases.

According to yet another preferred embodiment the prestressed force is provided in that the filling pipe and the pipe end part are mutually connected by an elastic body that is stretched and tensioned when the pipe end part is pushed forward as a consequence of the increased liquid pressure, and the pipe end part is pulled back by the elastic body when the liquid pressure decreases.

It is preferred that the applied elastic body (the band) is a rubber band, and it is particularly preferred that it is of a rubbery material.

It is particularly preferred that the applied constricted outlet is comprised of a valve that can be regulated, whereby the liquid flow can be set between full outflow and a minimum outflow.

It is particularly preferred that the valve is reset to a closing position with its minimum opening when the pipes are pulled telescopically together, and to a full opening when the pipes are pushed out.

It is preferred that the minimum outflow is provided by a channel running through the valve, which is permanently open for flow of liquid.

Furthermore, it is particularly preferred that the filling pipe is screwed onto the coupling threads of the saver sub and set up between the downwardly extending strut (bailes) of the pipe handler elevator so that the outlet mouthpiece lies above or adjoining the locking collar that is locked to each new casing section that is fitted into the casing string.

The device according to the invention is characterised in that the pipe end part is comprised of a constricted liquid outlet suited to set up an overpressure in the liquid in the filling pipe during filling of liquid to bring about said pushing out, and the pipe end part and the filling pipe are mutually connected with a body that is prestressed during the extension of the pipe end part and which contributes to pull the pipe end part back, i.e. when the supply of liquid stops.

According to a preferred embodiment the prestressing body is a spring that connects the pipe end part with a permanent inner pipe part.

Particularly preferred is that the prestressing body is a defined closed chamber/volume between the filling pipe and the pipe end part, which is filled with gas and set up to be compressed when the pipe end part is pushed forwards as a consequence of the increased liquid pressure and to be pulled back as a consequence of the gas expansion when the liquid pressure is reduced. The outer pipe is consequently able to glide along the outside of the inner pipe via the forward and rear gasket rings which between them define said closed chamber of a variable volume.

According to a preferred embodiment the prestressing body is an elastic element that mutually connects the filling pipe and the pipe end part, said element is stretched and tensioned when the pipe end part is pushed forwards as a consequence of the increased liquid pressure, and the pipe end part is pulled back by the elastic body when the liquid pressure decreases.

The filling pipe is preferably comprised of a permanent inner pipe part that carries an axial pipe part that can be manually displaced and fixed on the outside, and also an outer pipe end part that is connected to the intermediate pipe part, as given in the subsequent patent claim 11, 12 or 13.

The outer pipe end part preferably comprises a throttle valve that can be set between a closed position and an open position for liquid outflow.

Furthermore, a minimum outflow can be provided by a channel running through the valve, which is permanently open for flow of liquid.

According to yet another preferred embodiment the filling pipe is connected to a pipe handler elevator with a flexible bellows, particularly of the concertina type.

Advantage with the Invention

With this invented solution one can now avoid having to stop the operation for the sole reason of filling the casing internally. Thus, the casing can be started and be filled with liquid while one carries out the last assembly of threaded connections between the casing, that is stuck to the rigging deck of the rig (rotary) and a new pipe length, and during the lowering down of the casing itself with the new, screwed-on pipe lengths from the upper position to the lower position.

DESCRIPTION OF THE FIGS

Preferred embodiments of the invention shall be described in the following in more detail with reference to the enclosed figures, wherein:

FIGS. 1A-1C show in three steps, an overview of how a filling pipe 30 according to the present invention is used, in connection with an operation where liquid is supplied to a casing to be inserted down into a well in a formation after a given number of casings have been put together into a longer casing string.

FIG. 1A shows in a perspective partially in section, of an initial position for the filling apparatus that is fastened to the pipe handler of the drilling machine. A locking collar associated with an elevator is fitted to at least two downwardly extending carrier struts or bailes, said locking collar is connected to the top of the casing section. The extended filling apparatus is suspended centrally down from "saver sub" between the carrier struts inserted. The filling pipe 30 is ready to start the supply of liquid.

FIG. 1B shows the next step where the filling has started, and the outer telescope section of the pipe is pushed downwards in the casing opening as a consequence of the outlet mouthpiece is forming a contraction that increases the liquid pressure and thereby pushes the telescopic section downwards.

FIG. 10 shows the situation where the casing is led downwards in a controlled manner in that its locking slip anchoring to the deck comes loose. By lowering the drilling machine with a suspended filling pipe, which now delivers liquid into the casing, bailes and locking collar secured to the top of the casing, the casing string also sinks downwards in the well until the upper end is in a wanted position and the locking slip is activated again.

Figure 4:
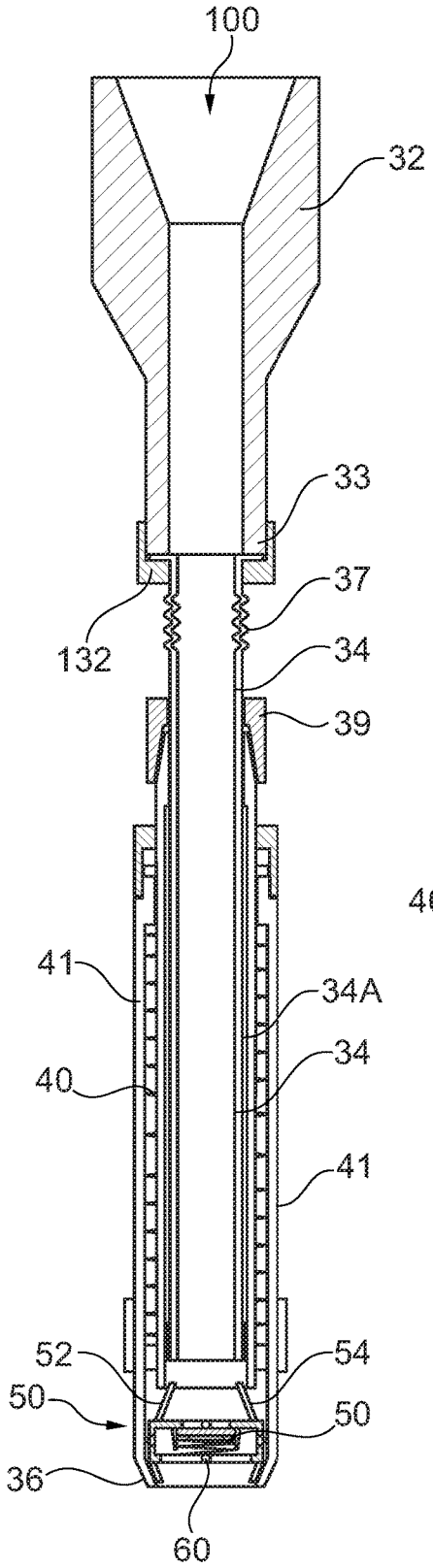
Figure 5:
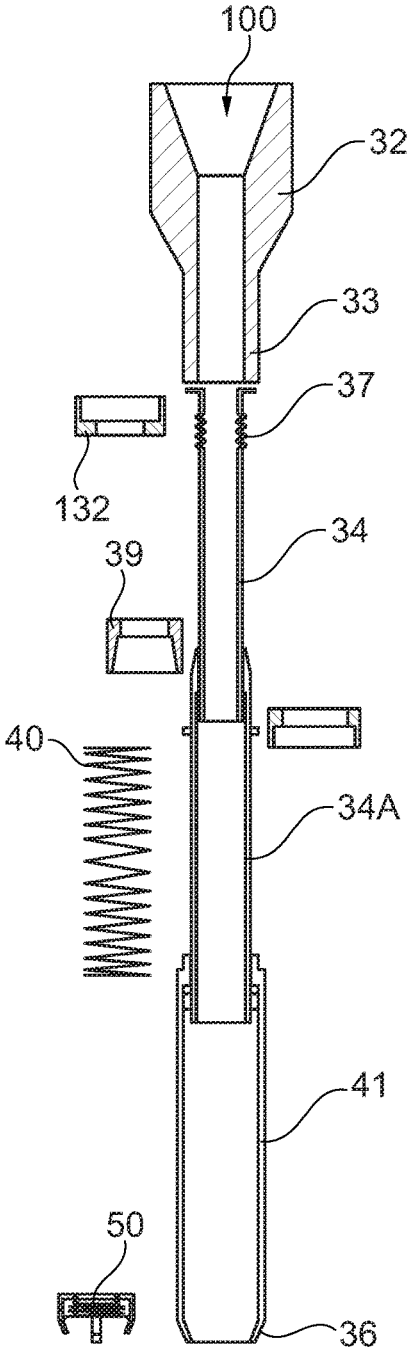

FIG. 4 shows a further tripartite variant, where the length of a pipe-formed intermediate piece can be adjusted with a screw device (similar to that shown in FIG. 2) and the lower pipe is connected with (on the outside of) the intermediate piece and is axially extendable. At the outlet there is further arranged an outlet nozzle with a valve that will open at a given fluid pressure. Before this valve opens, the lower mouthpiece with its outlet nozzle will be pulled down as a consequence of the force provided by fluid FIG. 5 shows the filling pipe as in FIG. 4, but as an expanded outline to show where the two axially moveable pipes are pushed maximum outwards.

Figure 6:
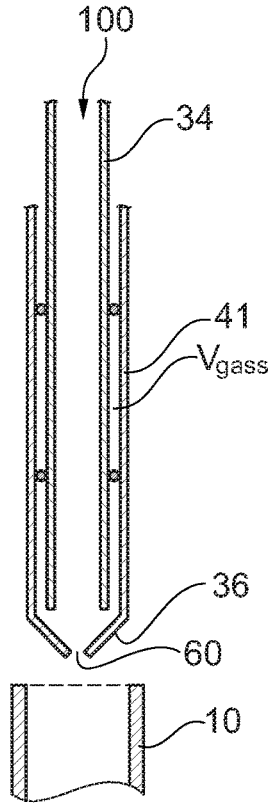

FIG. 6 shows a variant of the prestressing body where the pipe end part is connected to the permanent pipe part via a closed (ring formed) gas filled chamber where the gas compresses to a higher pressure when the pipe end part is pushed forwards, and the higher pressure leads the pipe back when the liquid pressure ceases.

DESCRIPTION OF PREFERRED EMBODIMENTS OF THE INVENTION

Figures 1A, 1B, 1C:
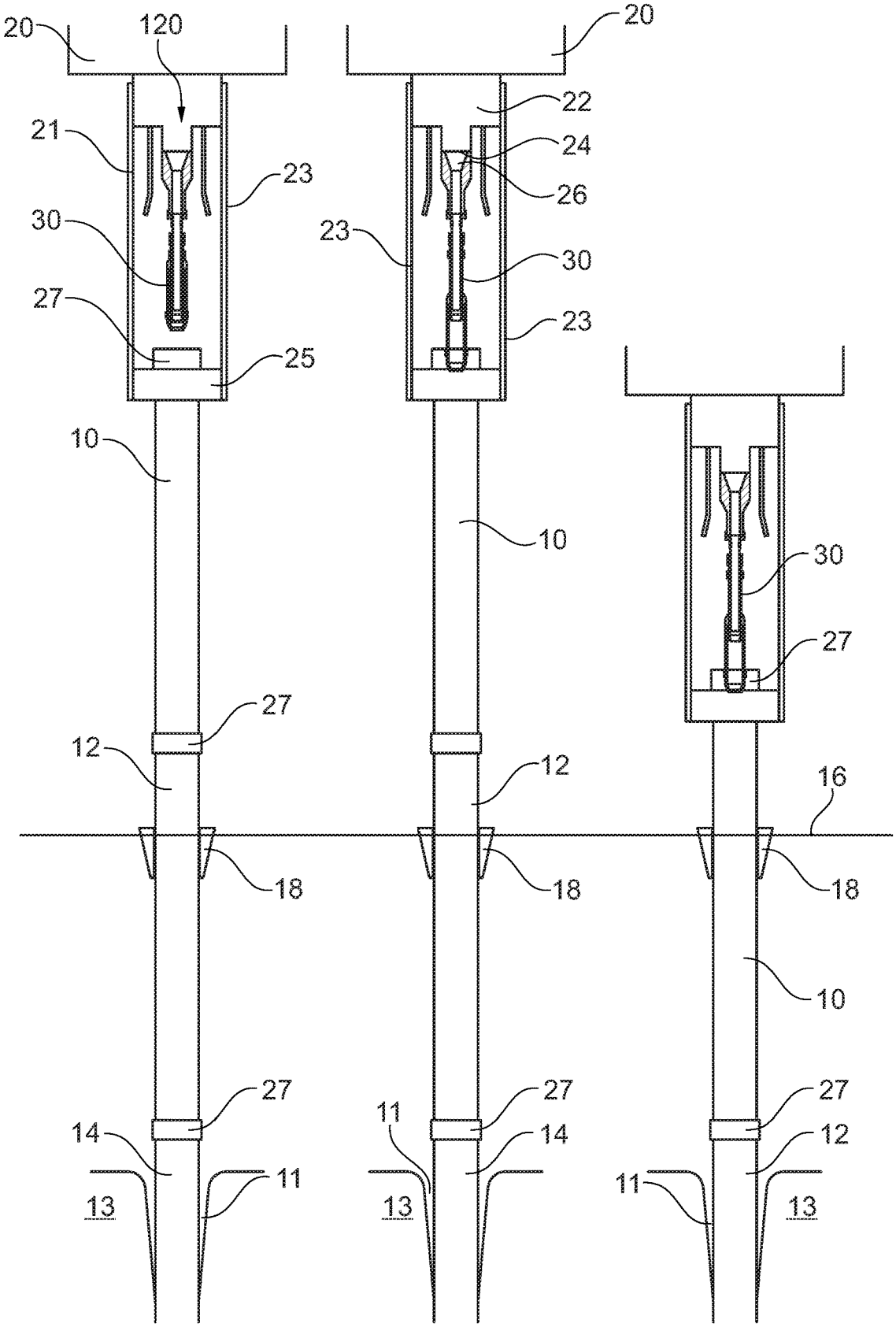

Initially reference is made to the FIG. 1A. The invention relates to fitting and insertion of a string of casing sections 10,12,14 in a well 11 that is drilled down through a formation 13 in the ground. A casing section 10 is about to be fitted to a mounting deck 16, in that it is screwed into the top of an already fitted pipe section 12 which in turn is screwed into the next section 14 which is already conveyed down under the drilling deck 16, to form a pipe string. Slips 18 are used for suspension of the already lowered casing strings 10-12-14 that are secured to the deck 16.

At the top schematically shown is the installations drilling machine 20 whose underside carries a "pipe handler" device 22. The bottom of this in turn composes "saver sub" 24 with a conical thread part 26 for coupling of various equipment. In this case, the top section of the filling pipe 30 is screwed into the bottom of the saver sub. Other equipment that is coupled to this drill string sections that during the previous drilling operation of the well 11, are screwed with the topside into the "saver sub" whereupon the drilling machine can rotate the whole drill string. The installation with the drilling machine 20 comprises also the system for supply of drilling liquid out of an adapted central channel 120 in the saver subs conical bottom piece.

To lift in place casing sections the underside of the elevators "pipe handler" 22 comprises downwardly extending struts or "bailes" 21 and 23, respectively, which at the bottom carry a locking collar 25 with rotary locking arms that can be locked in under the top flange 27 of the pipe section 10 such that the section 10 can be lifted upwards and be manoeuvred in vertical position over a pipe section 12 positioned underneath. The whole unit of bailes 21,23, fitting locking collar 25 and the filling pipe 30 can be flipped sideways and receive a new casing section that is lifted into a locking position in the collar 25. In FIG. 1A is the casing suspended in the locking collar 25, about to be screwed into the top flange 27 of the pipe 12 positioned underneath. In this phase can the filling of liquid into the top commence.

Figure 2:
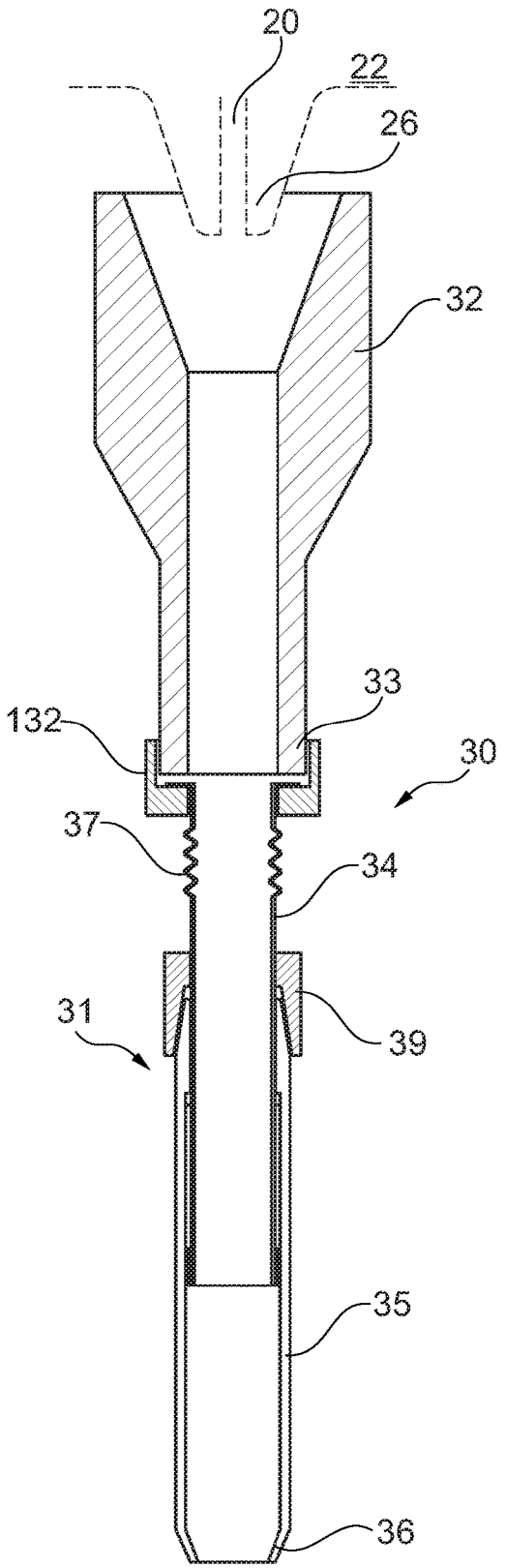
FIG. 2 shows a first preferred embodiment of a filling pipe that is divided in two, where a lower pipe casing section with an outlet mouthpiece, with the help of a screw connection to a permanent pipe, manually can be pushed out and be pulled back to adjust the pipe length. An articulated part (concertina bellows) 37 of the pipe is also shown.
Figure 3:
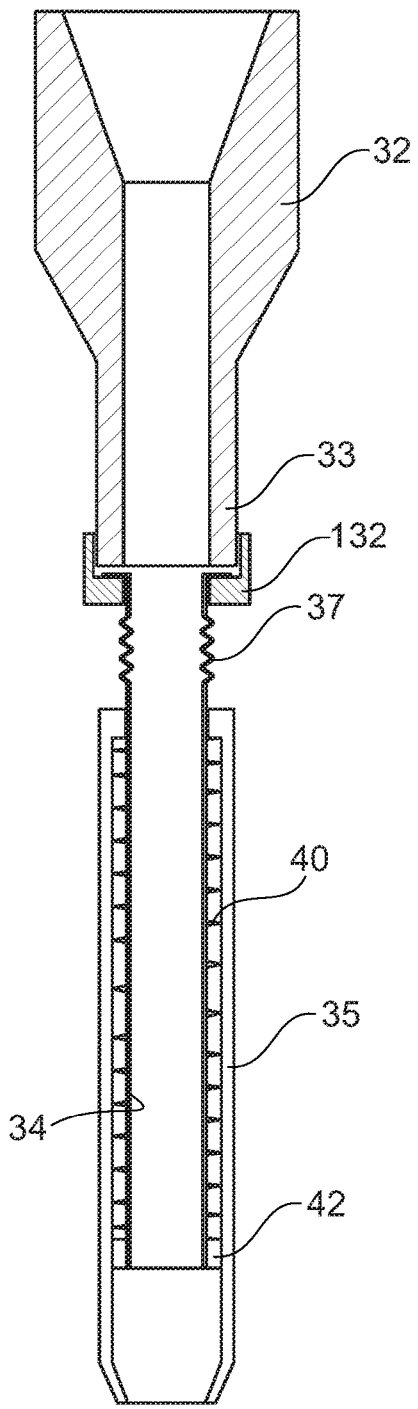
FIG. 3 shows a variant of the filling pipe where the lower pipe casing is connected to the main pipe part with a tension spring, as the lower pipe casing can be pushed out against the prestressing of the spring as a consequence of the fluid pressure that is set up during the filling. A detailed function shall be explained in the following.

Either through a screwed-on filling pipe 30 as shown in FIG. 2, and which has a manually adjustable length, or through pipes that automatically extends when they are supplied with liquid under pressure, as the figure versions in FIGS. 3 and 4 show.

At the same time as one starts to screw the pipe 10 into the top flange in the pipe 12 (FIG. 1B), the filling of liquid can start and furthermore the slips 18 are loosened and the whole assembly is lowered downwards so that the pipe length is led down in the well 11 in a controlled manner, see FIG. 10. The filling pipe 30 follows downwards and takes up a permanent position directed into the opening of the uppermost pipe 10.

FIG. 2 shows a first version of a filling pipe 30 for coupling to a saver sub 26. At the top the pipe 30 comprises a head part 32 set up to be connected by being screwed into the coupling threads of the saver sub 26. The lower part 33 of the head part 32 forms a hold for a lower, straight pipe section 31 that is divided into an upper permanent pipe part 34 and an axially moveable second (end) pipe part 35. The pipe part 35 can be displaced on the outside of the first pipe part, and forms a constriction 36 at the bottom. The second lower pipe part 35 can be fixed to the upper pipe part 34 with the help of a locking casing 39 which is screwed with internal threads into external threads uppermost in the pipe 35 which is thereby clamped firmly against the upper pipe part as a consequence of its conical shape. The length of the filling pipe can thereby be regulated manually, by pushing the lower pipe part upwards and downwards. The pipe part 34 is furthermore screw-coupled to the head part 32 with a threaded lock casing 132 that is screwed in on a correspondingly threaded lower part/bottom part 33 of the head part.

The upper pipe part 34 can comprise a flexible area 37 adjoining the hold in the head part 32. The area 37 has bellow shape, a concertina shape, which means that the pipe part 34 can bend sideways, also to a certain extent be clamped axially and be pulled outwards. This shape makes the filling pipe 30 very flexible to tolerate for example impacts, and it can be bent sideways to be adapted to the initial fitting of a new pipe section to the locking collar of the elevator to position the pipe section 10 to the underlying casing sections 12,14. With such a manually length regulating construction of the filling pipe 30 can the supply of liquid to the casing be made efficient and a considerable timesaving be achieved.

With the solution according to FIG. 2 there is no pressure load that decides the length of the pipe extension, as there is no spring present such as in the other versions. Here, one can manually adjust the length of the outer casing such that an operator can select a length based on the layout of the drilling machine, according to the actual need and according to the operator's own wish.

Alternative Embodiment of the Filling Pipe

FIG. 3 shows an embodiment according to the invention that is based on the filling pipe in FIG. 2, but where the axial movement of the end pipe (the outer pipe) 35 is not locked, but is regulated by a prestressing body that, according to a first alternative, is constructed as a spiral spring 40 which is fitted into the gap between the moveable end pipe 35 and the inner pipe 34. The end pipe 34/41 is thus preferably threaded onto the outside and in to the inner pipe 34 with the spring 40 fitted in the gap.

The lower part of the spiral spring 40 rests against an outwardly facing ring-formed shoulder 42 in the outer wall of the pipe 34, while the upper end is fastened at the top end of the displaceable end pipe 35. The spring 40 is clamped together when the end pipe 35 is led axially forwards as a consequence of the liquid with a pressure that is applied to the filling pipe. When the liquid pressure is reduced, the spring 40 will lead the outer pipe 35 back to the initial position up along the outside of the pipe 34. This is the simplest variant where one uses a return spring. Here there is no set of valves arranged inside the device, only a constricted "nozzle" in the bottom which means that when fluid flows, the liquid pressure increases such that the end pipe 35 is pushed forwards and the spring 40 is compressed. When the liquid flow ceases the spring 40 pulls the end pipe back to its initial position.

FIG. 4 shows a preferred variant, also with a basis in the version shown in FIG. 2. The filling pipe comprises a permanent pipe section 34 with an upper bellows 37 and a manually, axially adjustable pipe 34A outside the permanent pipe section 34. Outside the pipe 35 is also mounted a spring-prestressed outer pipe 41 which moves axially in the same way as the pipe 35 with regard to the pipe 34 in FIG. 3. The spring 40 and thereby the outer pipe 41 is stretched axially outwards when fluid under pressure is let into the filling pipe. When the pressure ceases, the spring 41 retracts and pulls the pipe 41 back up again as there is no longer an overpressure factor inside the filling pipe.

According to a preferred embodiment is there at the bottom of the outlet mouthpiece 36 arranged a valve 50. The valve covers the whole of the outlet opening 36 from the end pipe 41(35) and comprises an axially directed channel 60 which can be closed with the help of a valve body. I.e., when the valve is closed there is still a small through-running channel 60 open, something that enables that residual amounts of liquid can be drained out of the mouthpiece even after the filling to the casing is finished.

The valve body comprises a closing body which is constructed such and can be controlled such that when the pipes 41(35) and 34 are completely pulled together and the filling pipe is not in use, it is closed for outflow of liquid. When the pipes are pushed out, the closing body is reset to full opening. This control of the closing body can be carried out with the help of upwardly extending, arch-formed articulated arms 52 and 54, respectively, that can swing, one on each side, which is coupled at the bottom to the valve body via suitable articulated connections. The arms are spring-loaded so that in a free position they are pushed out away from each other and ensure the valve opens. When the arms 52/54 are pushed together, i.e. as a consequence of the pipes 35/41-34 being pushed together, the valve body 50 is reset to said closed position. FIG. 4 shows in a schematic outline that when the pipes are pulled together the inclined arms are led correspondingly upwards and into the outlet from the middle pipe 34. Then, the arms push against the pipe wall and are forced together and towards each other. This means that during the whole pulling up procedure, after the liquid flow 100 has stopped, liquid can drain out of the pipe. Even when the valve is moving towards the closed position, liquid will still be able to flow out through the smaller channel 60, which is always open. One obtains one advantage in that the risk of liquid spillage is minimised when the filling pipe is suspended freely between the bailes without being connected to any casings.

FIG. 6 shows schematically how the other version of the prestressing body can be formed. The figure shows the outer pipe end part 41, which can glide axially on the inner pipe part 34 over two separated gaskets. The two pipe parts are connected via the front 70 and the rear 72 ring gaskets, respectively, (between the pipes—and threaded into the pipe 34) such as O-rings of rubber, which between themselves and the pipes form a closed volume $V_{gas}$ filled with a gas. The pressure in this chamber/volume increases when the pipe end part 41 is pushed forwards. The volume $V_{gas}$ is filled with a compressible gas such as standard air but can be an inert gas. FIG. 6 also shows the upper casing section 10 that shall supply the liquid 100.

Practical Function of the Filling Pipe According to the Invention

At the moment the elevator has hoisted the casing 10 up and it is positioned for screwing into the upper pipe string section 12, the supply of liquid can start. The pressure will then increase as a consequence of the constricted outlet 36 and (for the versions in the FIGS. 3 and 4) the telescopic parts are pushed axially outwards, and extends all the way into the top of the casing (inlet to) 10. When the screwing-in is finished, the slips 18 are loosened, and the elevator sinks the whole assembly down to the position in FIG. 10, while the supply of liquid can continue the whole time.

When the pipe 10 is in the right position on the deck 16, the slips 18 are activated again and locks the pipe string. When the level of liquid has reached a sufficient height in the casing, the supply stops and the liquid pressure in the filling pipe sinks gradually. The elevator raises the filling pipe up still aligned with the opening of the casing, as the casing is completely or nearly completely empty/drained. Now, the next series of casings can be screwed in before the liquid filling continues in the next sequence.

According to the invention, the filling pipe is manufactured from a light metal (aluminium or the like), a plastic material, reinforced rubber or of a composite material so that the pipe can easily be handled manually by the operators on the platform. This means that it can be easily lifted in place manually and be removed from the saver sub coupling by the operators on the deck 16.

What is claimed is:

1. A method for supply of drilling liquid from a liquid storage comprising:

from a deck on an installation, conveying the drilling liquid down a casing string in a well with the help of a pipe handler comprising an elevator, and supplying the drilling liquid via an uppermost casing of the casing string, wherein the drilling liquid is supplied via a filling pipe to the uppermost casing during screwing of the uppermost pipe into the casing string where the filling pipe is extended by drilling liquid pressure during supplying the drilling liquid until the casing string is lowered down into a position where it is locked to the deck, and there is added liquid to a suitable level in the casing string, wherein the filling pipe comprises:

an inner pipe, a telescopically, axially moveable pipe end part with a constricted outlet which leads to the pipe end part being pushed axially outwards, and a body mutually connects the pipe end part and the inner pipe, wherein the pipe end part of the filling pipe is configured to extend in an axial direction when the drilling liquid is supplied under pressure, so that the pipe end part is pushed outwards against a prestressing force, and is pulled back by said prestressing force when the drilling liquid supply stops and the body is configured to be prestressed during the extension of the pipe end part, and which can pull the pipe end part back, and wherein:

the body comprises a spring connecting the pipe end part with the inner pipe part; or the body is a volume defined by the inner pipe and the pipe end part which is filled with gas and configured to be compressed when the pipe end part is pushed outwards as a consequence of the increased drilling liquid pressure, and to be pulled back as a consequence of gas expansion when the drilling liquid pressure decreases; or the body is an elastic body, and said body is stretched and tensioned when the pipe end part is pushed outwards as a consequence of the increased drilling liquid pressure, and the pipe end part is pulled back by the elastic body when the drilling liquid pressure decreases.

2. The method according to claim 1, wherein the prestressing force is provided to the pipe end part by the spring that is compressed as the pipe end part is extended when the drilling liquid is supplied under pressure, and the spring contributes to pull the pipe end part back to the initial position when the drilling liquid pressure ceases.

3. The method according to claim 1, wherein an elastic band is used as the elastic body, such as made from a rubber material.

4. The method according to claim 1, wherein the constricted outlet comprises a valve which switches the drilling liquid inflow between a full outflow and a minimum outflow.

5. The method according to claim 4, wherein the valve switches to a closed position with its minimum opening when the pipes are pulled together telescopically, and to full opening when the pipes are pushed out.

6. The method according to claim 4, wherein a minimum outflow is provided by a through-running channel in the valve, which is permanently open for drilling liquid flow.

7. The method according to claim 1, wherein the filling pipe is screwed into coupling threads of a saver sub and is set up between the pipe handler elevator's downwardly extending struts (bailes), so that the constricted outlet is lying above or adjoining the locking collar which locks onto each new casing section that is fitted in the casing string.

8. A device for delivery of drilling liquid to a casing in a well, the device comprising a filing pipe, wherein the filling pipe comprises:

an inner pipe, a pipe end part comprising a constricted liquid outlet configured to set up an overpressure in the filling pipe during the delivery of the drilling liquid, an intermediate pipe part which is manually displaceable on an external surface of the inner pipe, and a body mutually connects the pipe end part and the inner pipe, wherein:

the pipe end part of the filling pipe is configured to telescopically extend in an axial direction outwards during supplying the drilling liquid by drilling liquid pressure and then to withdraw, and the body is configured to be prestressed during the extension of the pipe end part, and which can pull the pipe end part back, wherein:

the body comprises a spring connecting the pipe end part with the inner pipe part, or the body is a volume defined by the inner pipe and the pipe end part which is filled with gas and configured to be compressed when the pipe end part is pushed forwards as a consequence of the increased drilling liquid pressure, and to be pulled back as a consequence of gas expansion when the drilling liquid pressure decreases, or the body is an elastic body, and said body is stretched and tensioned when the pipe end part is pushed forwards as a consequence of the increased drilling liquid pressure, and the pipe end part is pulled back by the elastic body when the drilling liquid pressure decreases.

9. The device according to claim 8, wherein the pipe end part comprises a throttle valve that can be reset between a closing position and an open position for drilling liquid outflow.

10. The device according to claim 9, wherein a minimum outflow is provided by a channel that runs through the throttle valve, which is permanently open for liquid flow.

11. The device according to claim 8, wherein the inner pipe comprises a flexible bellows.

* * * * *